United States Patent [19]

Gaia

[11] 4,349,802

[45] Sep. 14, 1982

[54] CURRENT LIMITING FUSE HAVING TRANSVERSE PARALLEL WEAK SPOTS

[75] Inventor: Aldino J. Gaia, St. Louis, Mo.

[73] Assignee: McGraw-Edison Company, Rolling Meadows, Ill.

[21] Appl. No.: 223,391

[22] Filed: Jan. 8, 1981

[51] Int. Cl.[3] ..... H01H 85/04

[52] U.S. Cl. ..... 337/159; 337/290

[58] Field of Search ..... 337/290, 291, 292, 293, 337/295, 297

[56] References Cited

U.S. PATENT DOCUMENTS

| | | | |
|---|---|---|---|
| 1,857,097 | 5/1932 | Glowacki | 337/295 |
| 2,028,721 | 1/1936 | La Mar | 200/135 |
| 2,489,501 | 11/1949 | Rensner | 200/135 |
| 2,720,567 | 10/1955 | Detch | 200/135 |
| 4,017,817 | 4/1977 | Ranzanigo | 337/295 |
| 4,041,435 | 8/1977 | Gaia | 337/290 |
| 4,118,684 | 10/1978 | Mollenhoff | 337/295 |

FOREIGN PATENT DOCUMENTS

| | | | |
|---|---|---|---|
| 1279821 | 10/1968 | Fed. Rep. of Germany | 21 C/70 |
| 236298 | 1/1945 | Switzerland . | |
| 1523575 | 9/1978 | United Kingdom | 85/10 |
| 1523576 | 9/1978 | United Kingdom | 85/10 |

*Primary Examiner*—George Harris

*Attorney, Agent, or Firm*—Charles W. MacKinnon; Ronald J. LaPorte; Jon Carl Gealow

[57] ABSTRACT

A current limiting fuse includes a fusible strip having semi-circular apertures formed therein, centrally disposed between the longitudinal edges of the strip. The diametric edges of the apertures lie transverse to the longitudinal edges of the fusible strip. The curved edges of the apertures are disposed in opposing relationship. Electrical weak spots which are less conductive than the remaining areas of the strip are defined between the semi-circular apertures and the longitudinal edges of the fusible strip. Semi-circular cut-outs may be included along the longitudinal edges of the fusible strip adjacent the centrally disposed semi-circular apertures to define the electrical weak spots between the cut-outs and centrally disposed apertures.

6 Claims, 3 Drawing Figures

CURRENT LIMITING FUSE HAVING TRANSVERSE PARALLEL WEAK SPOTS

BACKGROUND OF THE INVENTION

This invention relates to current limiting fuses having parallel electrical weak spots formed in the fusible strip thereof, and more particularly to such fuses wherein the parallel electrical weak spots are formed transverse to the length of said fusible strips.

Fuses including thin metal fusible strips having multiple punched sections defining electrical weak spots are well known in the art and are presently used extensively. Such fusible strips most often are found in enclosed cartridge type electric fuses. Electrical weak spots are formed in constricted areas along the electrical path of the fusible strip, generally between two adjacent apertures defined therein or between an aperture and an adjacent edge of the fusible strip such electrical weak spots are areas which are less conductive than the remaining areas of the strip. The apertures most commonly are long and narrow with relatively sharp corners and are positioned to lie transverse to the electrical path. Such apertures, and thereby the electrical weak spots, in the fusible strip are formed by removing material from strip stock through the use of special punch dies. Problems have been encountered in the manufacture of great quantities of such fusible strips because the punch dies required to form electrical weak spots having such configurations are often intricate, resulting in weakened structures which require considerable maintenance and frequent replacement.

Furthermore, the punch dies produce stress areas in the thin metal strip material during the punching process. The stress areas tend to physically weaken the fusible strip particularly in the area of the electrical weak spots which experience constant expansion and contraction due to heating and cooling of the strip during normal electrical operation. Such physical weakening of the fusible strip can cause premature failure thereof.

In addition, prior art fusible strips commonly contain unnecessarily large amounts of strip material in the vicinity of the electrical weak spots. While this does not necessarily effect fuse clearing characteristics, it may allow additional damaging current to pass during a short circuit or heavy overload, thereby increasing the fuse $I^2t$. Excess material in the vicinity of the arc which forms at the electrical weak spots deters rapid arc elongation causing lower arc voltages and higher currents.

SUMMARY OF THE INVENTION

Accordingly, it is a primary object of the present invention to provide a current limiting fuse comprising a new and improved fusible strip with electrical weak spots formed therein by punch dies, which fusible strip avoids the drawbacks of prior art fusible strips described heretofore.

It is another object of the present invention to provide a fusible strip of the last-mentioned type wherein the apertures formed therein to define the electrical weak spots are of configurations which overcome the drawbacks of the prior art.

It is yet another object of the present invention to provide a fusible strip of the above-mentioned type having predeterminedly shaped apertures therein defining electrical weak spots, which apertures are produced by punch dies of similar predetermined shapes, such punch dies requiring less frequent maintenance and replacement than punch dies used for electrical weak spots and prior art fusible strips.

It is a further object of the present invention to provide a current limiting fuse including a fusible strip having parallel weak spots which fuse is simple in construction, relatively low in cost and effective in use.

Briefly, a fuse according to the present invention comprises a fusible strip which includes semi-circular shaped apertures having a predetermined diameter length, centrally disposed in each longitudinal half of the fusible strip with the diametric edge lying transverse to the longitudinal edges of the fusible strip and having the curved edges thereof disposed in opposing relationship. Each aperture is defined with generally rounded corners at the junctions of the diametric and curved edges of the apertures thereby to avoid metal strain, particularly in the vicinity of the electrical weak spots defined thereby which are subject to physical deterioration promoted by electrical heating and cooling and associated expansion and contraction of the fuse element.

Smaller semi-circular apertures or cut-outs may be defined adjacent the larger semi-circular apertures, along the longitudinal edges of the fusible strip, for the purpose of narrowing the electrical weak spots.

The semi-circular apertures defined in the fusible strip are generally larger and relatively less intricate than those found in prior art fusible strips, yet the new and improved fusible strips according to the invention operate with substantially identical clearing and with improved $I^2t$ characteristics. This results in a material cost reduction particularly when the strips are formed of precious metal and also permits the use of stronger punch dies which require less frequent maintenance and replacement.

DESCRIPTION OF PREFERRED EMBODIMENT

Figure 1:
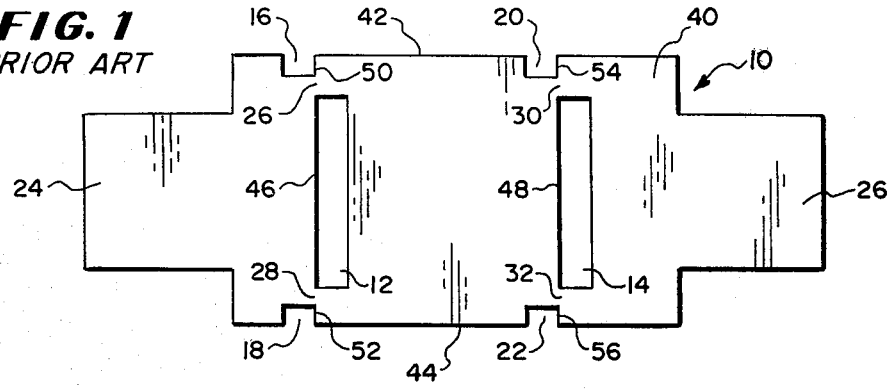
FIG. 1 PRIOR ART
FIG. 1 is a front view of a prior art fusible strip.

Referring now to the drawings in greater detail, FIG. 1 illustrates a prior art fusible strip designated by the numeral 10 having a main body 40 of a first predetermined width, end sections 24 and 26 of reduced width and longitudinal edges 42 and 44. The main body 40 of fusible strip 10 includes relatively thin elongated rectangularly shaped slots designated by the numerals 12, 14, each of which is centrally disposed between longitudinal edges 42 and 44 such that the longest dimension of the slot lies transverse to the longitudinal edges 42 and 44 of main body 40. Along longitudinal edges 42 and 44 are defined rectangularly shaped cut-outs or apertures 16, 20 and 18 and 22, respectively which are adjacent centrally disposed elongated apertures 12 and 14, but are offset therefrom such that only the leading edges 50, 52 of cut-outs 16, 18, respectively and edges 54, 56 of cut-outs 20, 22, respectively, aligned with edges 46 and 48 respectively of centrally disposed apertures 12 and 14 thereby to form electrical weak spots 26, 28 and 30 and 32, respectively as seen in FIG. 1. Slots 12 and 14 and cut-outs 16, 18, 20 and 22 are formed in strip 10 by punch dies having similar configurations.

Figure 2:
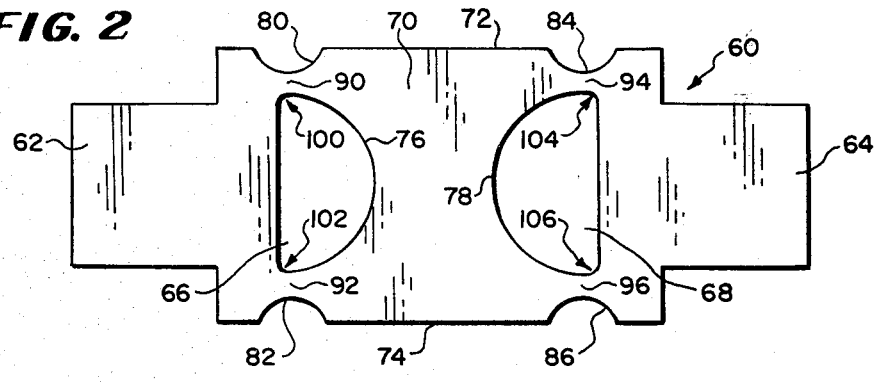
FIG. 2 is a front view of a first embodiment of an improved fusible strip according to the invention.

Fusible strip 60 as seen in FIG. 2 is a first embodiment of a fusible strip according to the invention, representing an improvement over the prior art strip 10 of FIG. 1. Fusible strip 60 is generally formed from a thin sheet of metal such as copper alloys, copper, or silver. Strip 60 has a main body 70 of a first predetermined width, end sections 62 and 64 of a reduced width and longitudinal edges 72 and 74. Main body 70 includes punched apertures 66 and 68 each of which is generally semi-circular in shape and centrally disposed between longitudinal edges 72 and 74 with the diametric or longest dimension thereof extending perpendicularly to longitudinal edges 72 and 74. The curved edges 76, 78, respectively, of semi-circular apertures 66 and 68 are positioned in opposing relationship. Along longitudinal edges 72 and 74 of main body 70 are additional semi-circular apertures or cut-outs 80, 84 and 82, 86 respectively also preferably punched from strip 60. Cut-outs 80, 82 and 84, 86 are positioned so that the center points thereof are longitudinally offset predeterminedly from the diametric edges of centrally disposed apertures 66 and 68, respectively. The distance of offset between the center points of the cut-outs and the diametric edges of the centrally disposed apertures can be varied depending upon the size of the electrical weak spot desired. Centrally disposed apertures 66 and 68 in combination with cut-outs 80, 82 and 84, 86, form respective electrical weak spots 90, 92 and 94 and 96, which are electrically less conductive than the remaining areas of the strip. Centrally disposed apertures 66 and 68 are shaped such that the corners 100, 102 and 104, 106, respectively, at the junction of the curved and flat edges thereof are rounded rather than sharp as in the case of the elongated slotted apertures of the prior art fusible strip 10 of FIG. 1. The rounding of the corners 100, 102, 104 and 106 is done in order to reduce metal strain or fatigue in the thin metal sheet of fusible strip 60 particularly at weak spots 90, 92, 94 and 96. The rounding of the corners of apertures 66, 68 also reduces the frequency of maintenance and replacement of the punch dies used to form the apertures.

Figure 3:
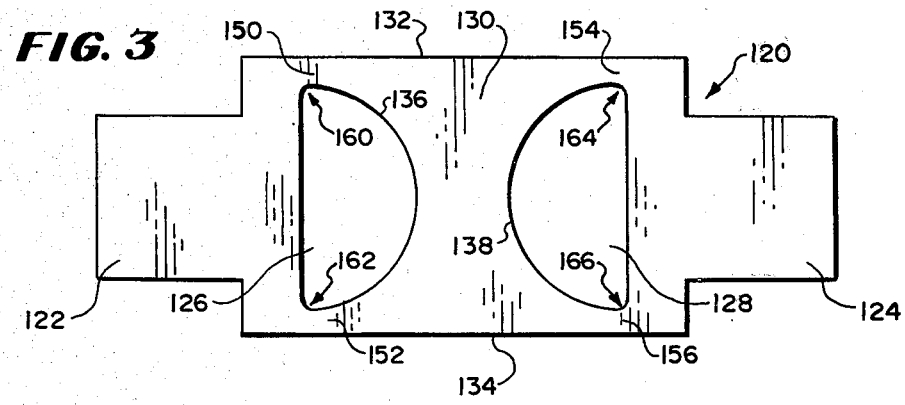
FIG. 3 is a front view of an alternative embodiment of an improved fusible strip according to the invention.

A second embodiment of a fusible strip according to the invention is illustrated by fusible strip 120 seen in FIG. 3. Fusible strip 120 may also be formed from a thin sheet of metal such as copper alloys, copper or silver. Strip 120, like fusible strip 60, has a main body 130 of a first predetermined width, end sections 122 and 124 of a reduced width and longitudinal edges 132, 134. Main body 130 includes punched apertures 126 and 128 each of which is generally semi-circular in shape and centrally disposed between longitudinal edges 132 and 134 with the diametric or longest dimensioned thereof also extending perpendicularly to longitudinal edges 132 and 134. Apertures 126 and 128 have curved edges 136 and 138 positioned in opposing relationship. Centrally disposed apertures 126 and 128 in combination with longitudinal edges 132 and 134 define electrical weak spots 150, 152 and 154, 156, respectively. Centrally disposed apertures 126 and 128 are shaped such that the corners 160, 162 and 164, 166, respectively, are rounded. Such rounding reduces metal strain or fatigue in the thin metal sheet particularly at weak spots 150, 152, 154 and 156, respectively.

The clearing characteristics of the fusible strips shown in FIGS. 1, 2 and 3 are substantially identical at 135%, 200% and 500% of rated currents. However, the amount of damaging current which the fusible strip allows to flow over a predetermined time interval during a short circuit or heavy overload; i.e. the $I^2t$ characteristic, is 10% less in the fusible strip embodiments of FIGS. 2 and 3 as compared to that of the fusible strip shown in FIG. 1. The improvement in the $I^2t$ characteristic of the fusible strip embodiments of FIGS. 2 and 3 is the result of lower arcing due to the absence of excess material in the vicinity of the arc which forms at the electrical weak spots thereof, causing a more rapid arc elongation, and therefore, higher arc voltages and lower currents. Thus the fusible strip embodiments of FIGS. 2 and 3 when shunted in a short circuit or heavy overload, permit approximately 10% less short circuit heating and thermal energy into the protected circuit than does the fusible strip of FIG. 1.

While the operating characteristics of FIGS. 1, 2 and 3 are substantially identical, it can be seen that the fusible strip embodiments of FIGS. 2 and 3 have greater material removal, i.e. centrally disposed apertures 66, 68, 126 and 128 respectively, are considerably larger than centrally disposed apertures 12 and 14 of the strip of FIG. 1 and the edge apertures 80, 82, 84 and 86 of the strip embodiment of FIG. 2 are larger than edge apertures 16, 18, 20 and 22 of the strip 10 of FIG. 1. The amount of material removed, in addition to not altering the operating characteristics of the fusible strip, also results in a reduction in materials needed to form a fusible strip according to the invention. The improved fusible strip construction according to the invention results in a considerable material savings, which is particularly important when the strips are formed of precious metal, such as, for example, silver. As described heretofore, the manner employed in forming the fusible strips of FIGS. 1, 2 and 3 is by punching out the apertures with a punch press or the like apparatus. The strength of the die required to punch the apertures of the fusible strip 60 and 120 illustrated in FIGS. 2 and 3, respectively, is considerably greater than that of the die required to punch the apertures of fusible strip 10 in FIG. 1. The configuration of the apertures of fusible strips 60 and 120 avoids the use of elongated dies having relatively small widths compared to their lengths which configuration results in rapid deterioration of the die especially when utilized in high speed mass production of fusible strips.

In addition, the sharp corners of the apertures in fusible strip 10 cause increased strain and fatigue in the thin fusible metal strip material at the time of punching and later during use when heating occurs at the electrical weak spots thereof. These problems are minimized in the fusible strips according to the invention, shown in FIGS. 2 and 3 wherein no sharp corners are formed in the apertures defining the electrical weak spots.

While particular embodiments of the invention have been shown and described, it should be understood that the invention is not limited thereto since many modifications may be made. It is therefore contemplated to cover by the present application any and all such modifications as fall within the true spirit and scope of the appended claims.

I claim:

1. A fuse comprising an elongated electrically conductive, fusible strip, said strip having first and second opposite end portions, a main body portion joining said end portions and longitudinal edges defining the width of said main body portion, said main body portion defining first and second generally semi-circular apertures arranged in longitudinally spaced relation, between said longitudinal edges, the diametric edges of said semi-circular apertures extending transverse to said longitudinal edges of said strip, said main body portion including areas which are predeterminedly less conductive than the remaining areas of said fusible strip, the electrically less conductive areas being disposed between said longitudinal edges and said semi-circular apertures.

2. A fuse as claimed in claim 1 wherein said first and second opposite end portions of said strip are of a width smaller than that of said main body portion.

3. A fuse as claimed in claim 1 wherein said first and second semi-circular apertures are oriented with the curved edges thereof in opposing relationship.

4. A fuse as claimed in claim 1 wherein said first and second semi-circular apertures are oriented with the diametric edges thereof transverse to said longitudinal edges of said strip and wherein said strip further defines a plurality of cut-outs formed therein along said longitudinal edges, said cut-outs being aligned with the diametric edges of said first and second semi-circular apertures.

5. A fuse as claimed in claim 1 or claim 4 wherein the corners defined at the junction of the diametric and curved edges of said semi-circular apertures are rounded for alleviating fatigue in said strip at said electrically less conductive areas.

6. A fuse as claimed in claim 4 wherein said diametric edges of said first and second semi-circular apertures extends perpendicularly to said longitudinal edges of said strip and wherein said cut-outs are semi-circular and oriented with the center point thereof predeterminedly longitudinally offset from the diametric edges of said first and second semi-circular apertures, the areas between the edges of said cut-outs and said first and second semi-circular apertures defining said electrically less conductive areas of said strips.

* * * * *